United States Patent [19]

Anderson

[11] Patent Number: 5,049,724

[45] Date of Patent: Sep. 17, 1991

[54] THERMAL PROTECTION BLANKET FOR A BLOW OUT PREVENTOR

[76] Inventor: Robert A. Anderson, 4245 - 53 Street, Red Deer, Alberta, Canada, T5M 2E1

[21] Appl. No.: 336,834

[22] Filed: Apr. 12, 1989

[51] Int. Cl.[5] ..... H05B 3/34

[52] U.S. Cl. ..... 219/212; 219/535; 219/529

[58] Field of Search ..... 219/211, 212, 535, 528, 219/529, 549

[56] References Cited

U.S. PATENT DOCUMENTS

| | | | |
|---|---|---|---|
| 1,355,382 | 10/1920 | Blume | 219/211 |
| 1,691,472 | 11/1928 | Graham | 219/211 |
| 2,277,772 | 3/1942 | Marick | 219/211 |
| 2,287,915 | 6/1942 | Taylor | 219/211 |
| 2,298,299 | 10/1942 | Joy | 219/211 |
| 2,404,736 | 7/1946 | Marick | 219/535 |
| 2,458,119 | 1/1949 | Van Daam | 219/211 |
| 3,079,486 | 2/1963 | Winchell | 219/211 |

FOREIGN PATENT DOCUMENTS

| | | | |
|---|---|---|---|
| 46184 | 3/1966 | German Democratic Rep. | 219/211 |
| 54-42862 | 4/1979 | Japan | 219/301 |
| 54-159749 | 12/1979 | Japan | 219/301 |
| 528697 | 11/1972 | Switzerland | 219/535 |
| 645843 | 11/1950 | United Kingdom | 219/535 |

*Primary Examiner*—Teresa J. Walberg
*Attorney, Agent, or Firm*—Anthony R. Lambert

[57] ABSTRACT

A thermal protecting blanket for a blow out preventer. The blanket is specially adapted for use in hazardous environments. It includes a flexible cover custom fitted to the shape of the blow out preventor, an electrical heating element disposed on the inside of the flexible cover, and which is detachable, and the cover having a closable opening so that it may be closed to insulate the well head control device, and opened to permit access to the device during servicing. The electrical heating element is detachable, and self regulating. External connections for the blow out preventor pass through openings in the flexible cover, and the openings are held tight against the external connections by a drawstring. The fabric cover is made of oil resistant, water resistant and fire resistant material.

3 Claims, 4 Drawing Sheets

THERMAL PROTECTION BLANKET FOR A BLOW OUT PREVENTOR

FIELD OF INVENTION

This invention relates to an apparatus for the thermal protection of well head control devices such as blow out preventors (BOPs).

BACKGROUND OF THE INVENTION

BOPs often operate in extremely cold environments where temperatures reach below −40°. All of these BOPs operate under high pressure and contain rubber parts which provide a sealing function for the well contents. Extreme cold can affect the sealing function of the rubber parts and this can lead to failure of the seal, resulting in a dangerous environment. In addition, normal cold weather operation of the BOP can lead to a build-up of frost or rime in the bore of the BOP which impairs its safety.

In the past, methods of heating BOPs have involved: heating water in a boiler, and transferring the heat from the heated water to the BOP through a heat exchanger; or blowing air through a heated glycol filled radiator onto the surface of the BOP. These methods were inefficient due to a loss of heat to the environment.

Another method utilized a rigid box or container surrounding the BOP. While this improved heat retention, access to the BOP was restricted.

SUMMARY OF THE INVENTION

The present invention helps avoid the difficulties of the prior art and provides, in one aspect, a thermal protecting apparatus for a blow out preventor comprising:

a flexible cover fitted to the shape of the blow out preventor;

an electrical heating element disposed on the inside of the flexible cover;

the cover being adjustable between a first position in which the blow out preventor is insulated from the environment and a second position in which the blow out preventor is exposed to and accessible from the environment;

means for fastening the cover in the first position; and an electrical power source connected to the electrical heating element.

Further summary of the invention may be found in the claims forming a part of this patent.

BRIEF DESCRIPTION OF THE FIGURES

In drawings which illustrate embodiments of the invention, by way of example.

DESCRIPTION OF THE PREFERRED EMBODIMENTS OF THE INVENTION

Two types of BOP are widely used for well head pressure control. The embodiments of the invention described here are custom tailored to the configuration of the ram type and annular type of BOP.

Figure 1:
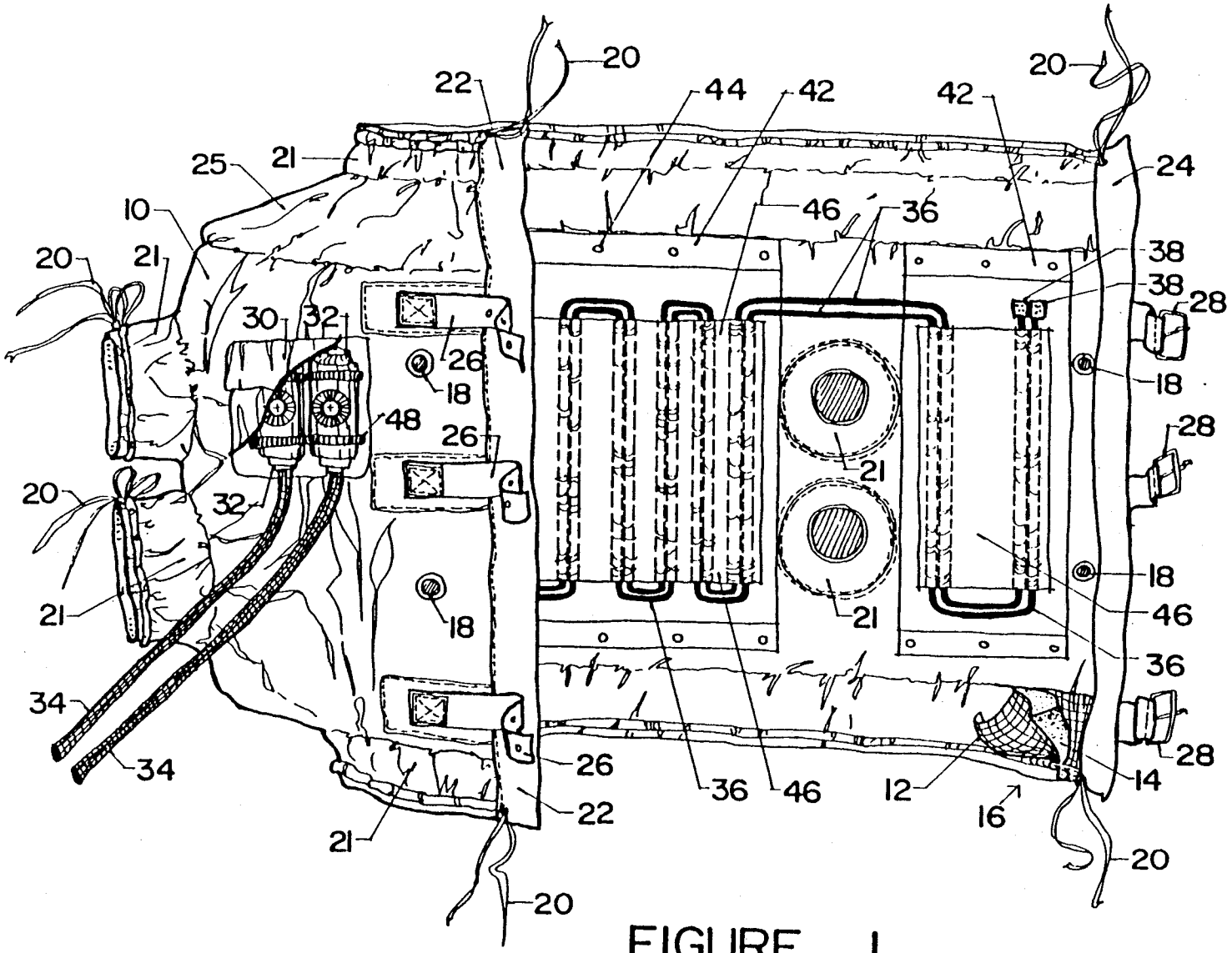
FIG. 1 is a perspective of a heating cover according to the invention for a ram type BOP heater in which the heating cover is in open position.
Figure 2:
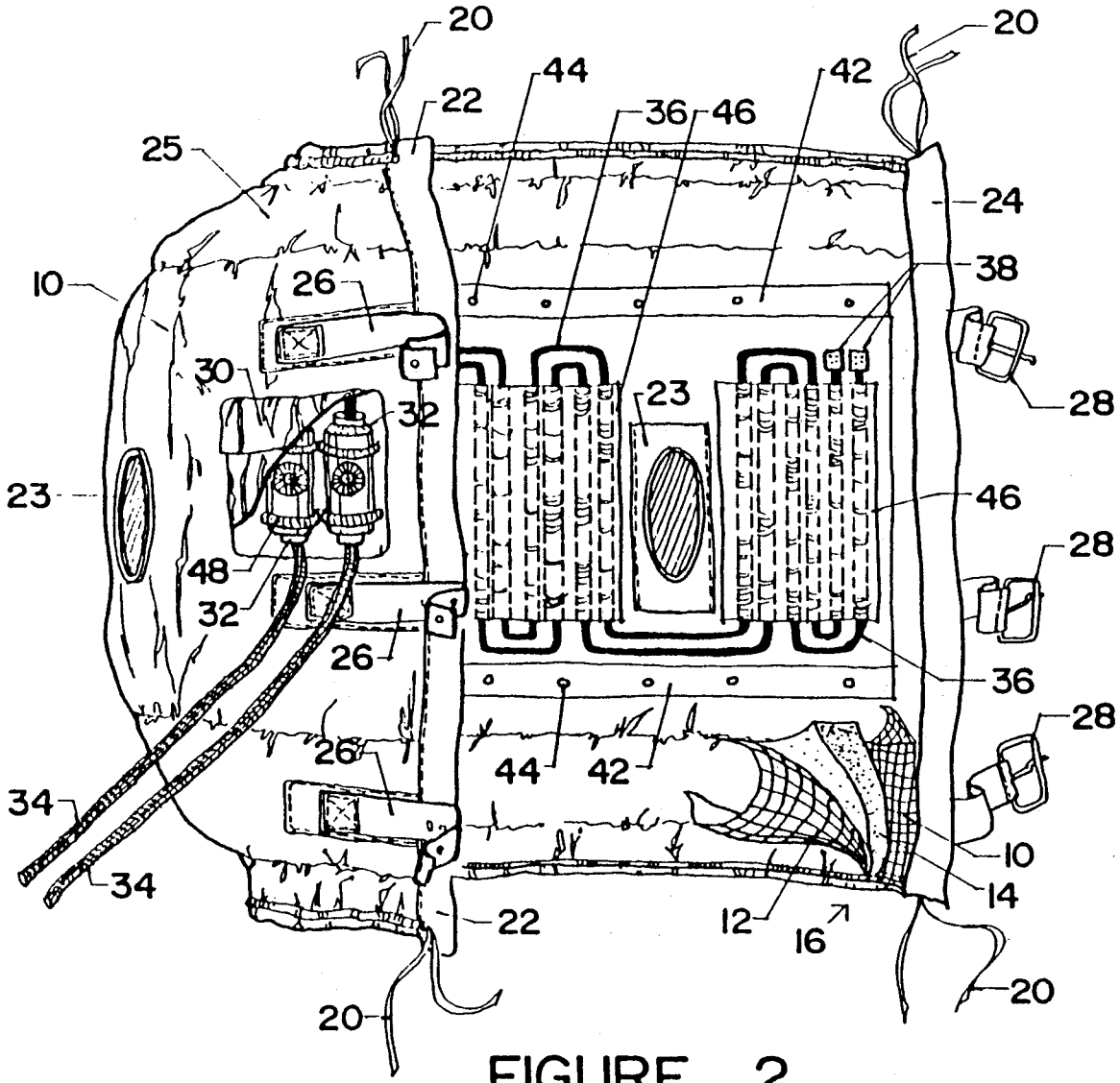
FIG. 2 is a perspective of a heating cover according to the invention for an annular BOP heater in which the heating cover is in open position.
Figure 3:
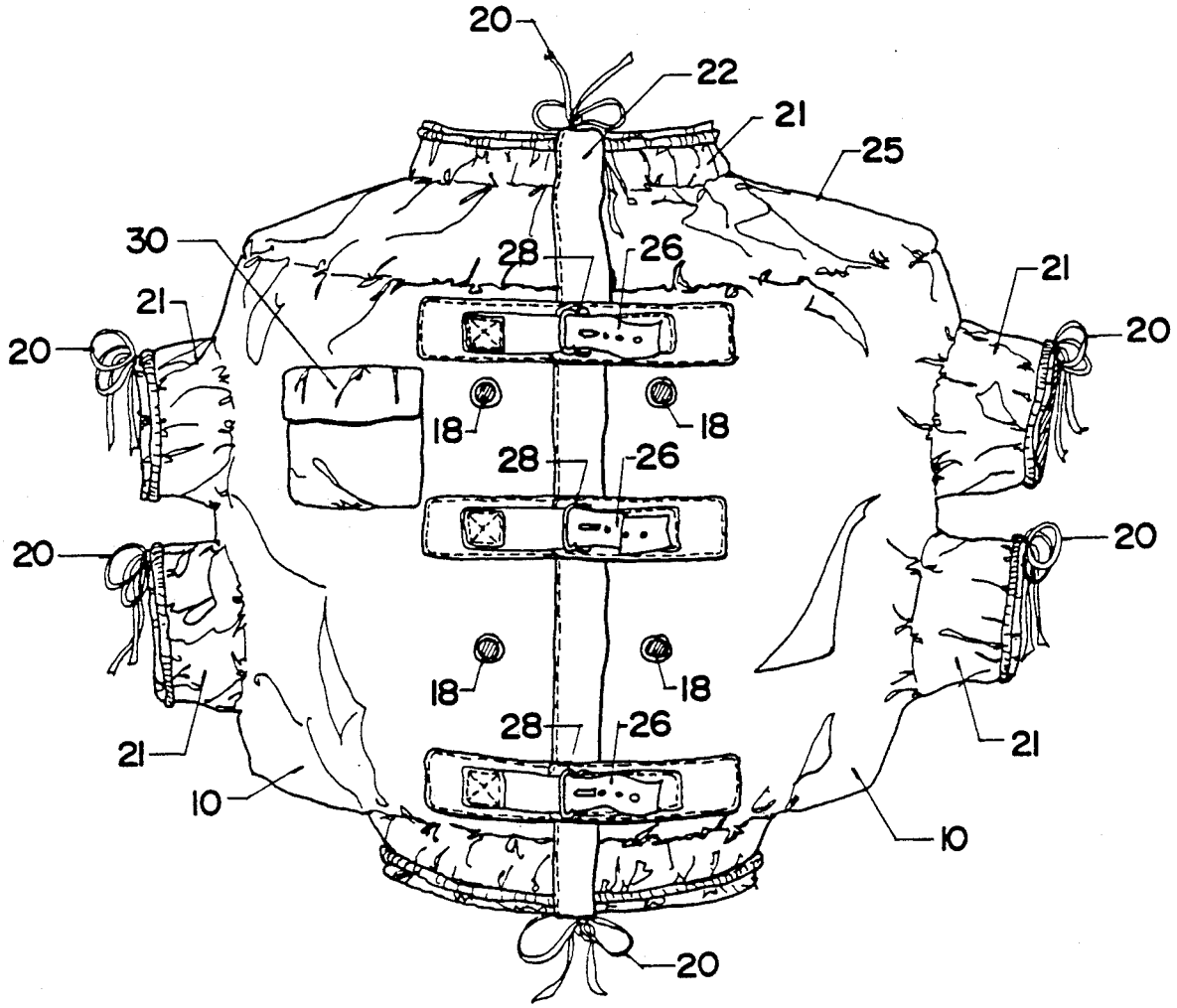
FIG. 3 is a front view of a heating cover according to the invention for a ram type BOP.
Figure 4:
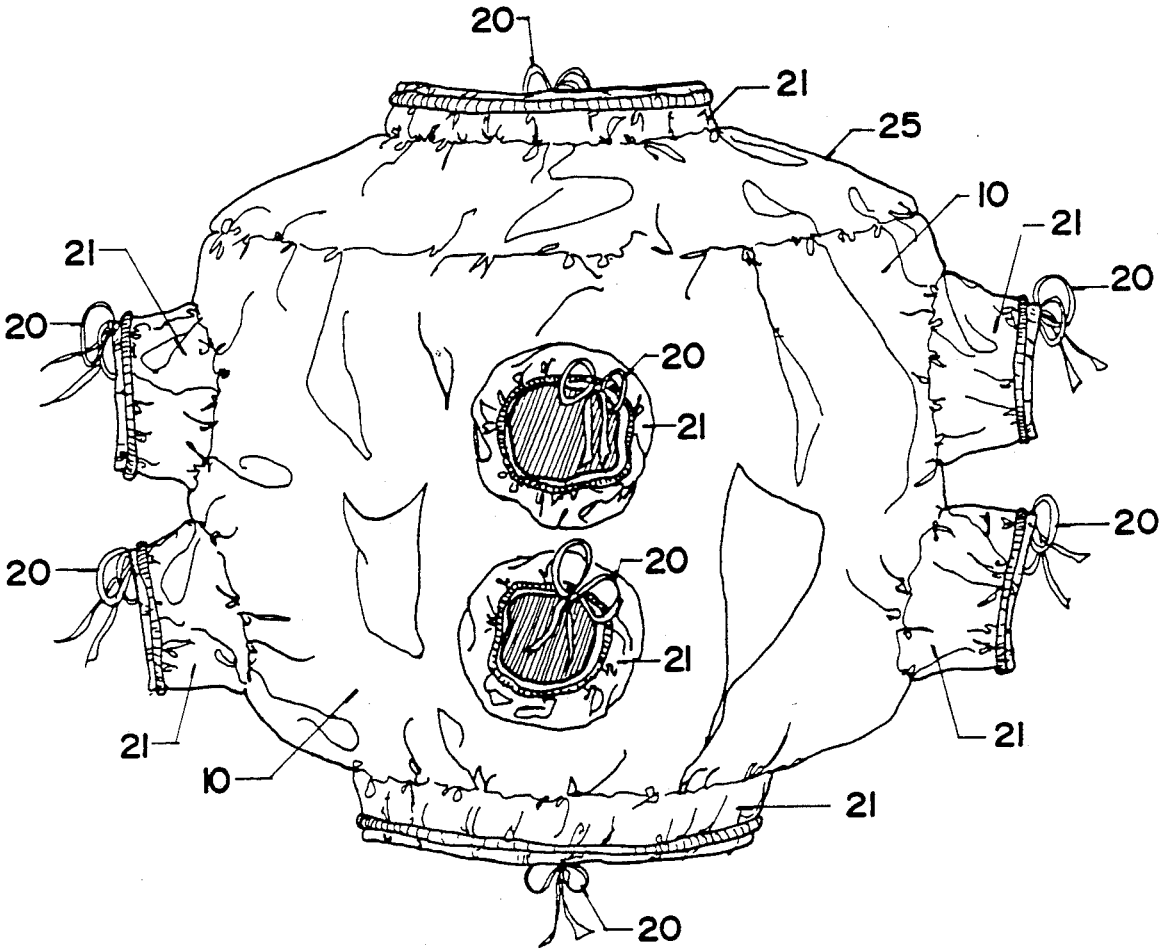
FIG. 4 is a rear view of a heating cover according to the invention for a ram type BOP.

FIG. 1 shows a heating cover custom contoured for the ram type BOP. FIG. 2 shows a heating cover custom contoured for the annular type BOP. In both designs, the cover is made of an outer shell 10, inner shell 12 and a layer of insulation 14 sandwiched between the inner shell 10 and outer shell 12. The outer shell 10 is preferably made of a fire resistant, oil resistant, and water resistant flexible fabric functional from −40° to 100° C. such as Arctic Hyprene, available from Norseman Shelters. The inner shell 12 is made of woven glass fibre. The insulation 14 is preferably a layer of solimide foam or other fire resistant material. The layers of fabric and insulation are shown in the area generally located at 16, and are sewn together in known fashion about the perimeter of the cover.

The flexibility of the cover permits it to be wrapped around the BOP. Drawstrings 20 on sleeve 21 are used to seal the cover against the external connections and well head connection of the BOP by tightening of the drawstrings 20. Outlets 18 are for the hydraulic connections to the ram type BOP. In FIG. 2, openings 23 receive the external connections of the annular type BOP. Overlapping flaps 22 and 24 have complementary VELCRO TM strips (VELCRO is a trade mark of Velcro Corporation) on their inner and outer facing surfaces respectively. The flaps 22 and 24 and straps 26 with complementary buckles 28 fasten the cover about the BOP. Straps 26 are preferably made of nylon.

The cover is substantially rectangular and is custom fit for the particular BOP and is provided with enclosing ends 25 so that when the cover is in its closed position, insulating the BOP, it is substantially cylindrical. The flaps 22 and 24 are at the longitudinal ends of the cover.

Pouch 30, shown partially cut-away in FIGS. 1 and 2, houses explosion proof connectors 32, which are readily commercially available. Connectors 32 connect 110 v power cords 34 to the self regulating heating cable 36. Self regulating heating cable 36 is rated at 110 v × 10–20 watts/Ft, approved for hazardous environment under the appropriate Canadian standards and may also be readily commercially obtained. Self regulating heating cables 36 terminate in explosion proof terminators 38, also readily commercially available. The self regulating heating cables 36 are preferably selected to maintain the BOP or other well head control device within a range of temperatures specified by the manufacturers of the seals of the BOP to be satisfactory for the performance of the rubber seals. For example, typical rubber seals operate in a temperature range of −7° C. to +60° C.

Self regulating heating cables 36 are fastened by stitching between the detachable pads 42 and internal pads 46 are fastened to the inner shell 12 by snaps 44. Separated pads 42, as shown for the ram type BOP in FIG. 1, may be used to bridge openings for external connections to the BOP. The pads 42 are preferably made of fire resistant, oil resistant, and water resistant material, such as woven glass fibre. The internal pads 46 are made of similar material and may be lined with metal wool to improve heat distribution.

The wire size in the self regulating heating cables 36 should be adjusted to meet temperature rating limitations set by the Canadian Standards Association according to the well bore fluids being used.

One or more RTDs (not shown) may be inserted into the pads 42 or 46 in contact with outside terminals for checking the inside temperature of the cover, without removal of the cover. Straps 48 are preferably strain relief detention straps, which are readily commercially available.

If desired, the self regulating heating cables 36 may be plugged into a breaker box (not shown). The breaker box may be wired to kick out if the ground connection is broken.

In use, the cover may be readily applied and fitted to the BOP. Straps 26, flaps 22 and 24 and drawstrings 20 are secured to provide a substantially airtight cover for the BOP. In the case of the annular type BOP, the openings 23 fit snugly against its external connections. The temperature of the BOP is regulated by the self regulating heating cable 36. Ready access to the BOP for servicing is provided by the straps 26 and VELCRO TM flaps 22 and 24.

Clearly, other methods of fastening the cover about the BOP may be used. For example, instead of VELCRO TM flaps and buckles, rings and hooks, zips, buttons or straps only could be used. Overlapping flaps are desirable to improve the insulating capacity of the cover. Elasticized material at the edge of each opening may be used instead of drawstrings for fastening the opening of the cover about external connections to the well head control device.

Other alternative but equivalent devices may be constructed by persons skilled in the art, but these are intended to be covered by the claims which follow.

I claim:

1. A thermal protecting apparatus for a blowout preventor, having external connections, the thermal protecting apparatus comprising:

a flexible cover having a plurality of openings fitted to the shape of the blowout preventor external connections;

an outer pad detachably attached to the inside of the flexible cover;

an inner pad having first and second sides, the first side being attached to the outer pad;

a self regulating electrical heating element disposed between the inner and outer pads;

the cover being adjustable between a first position in which the blowout preventor is insulated from the environment and a second position in which the blowout preventor is exposed to and accessible from the environment;

a metallic, heat conductive lining attached to the second side of the inner pad and disposed on the inside of the electrical heating element such that the conductive lining is disposed between the electrical heating element and the blowout preventor when the cover is in the first position;

means for fastening the cover in the first position; and an electrical power source connected to the self regulated electrical heating element.

2. A thermal protecting apparatus for a blow out preventor, having external connections, comprising:

a flexible cover having a plurality of openings fitted to the shape of the blow out preventor external connections;

an electrical heating element disposed on the inside of the flexible cover;

the cover being adjustable between a first position in which the blowout preventor is insulated from the environment and a second position in which the blow out preventor is exposed to and accessible from the environment;

means for fastening the cover in the first position;

an electrical power source connected to the electrical heating element; a metallic, heat conductive lining disposed on the inside of the electrical heating element such that the conductive lining in disposed between the electrical heating element and the blowout preventor when the cover is in the first position; and in which the cover comprises an outer layer, a middle layer made of flexible insulating material and an inner layer made of fire, oil and water resistant material.

3. The thermal protecting apparatus of claim 1 in which the electrical power source is connected to the electrical heating element by explosion proof connectors.

* * * * *